United States Patent [19]

Irizarry

[11] Patent Number: 4,955,422

[45] Date of Patent: Sep. 11, 1990

[54] SHOWER CURTAIN OPERATOR

[76] Inventor: Guillermo Irizarry, 910 Briarcliff Dr., Valrico, Fla. 33594

[21] Appl. No.: 379,263

[22] Filed: Jul. 13, 1989

[51] Int. Cl.[5] ..... A47H 5/00

[52] U.S. Cl. ..... 160/344

[58] Field of Search ..... 160/344, 345, 340, 341, 160/346, 347, 123, 124, 126

[56] References Cited

U.S. PATENT DOCUMENTS

| | | | |
|---|---|---|---|
| 803,347 | 10/1905 | Kroder | 160/344 |
| 917,105 | 4/1909 | McCabe | 160/124 X |
| 975,257 | 11/1910 | Kroder | 160/344 X |
| 978,609 | 12/1910 | McBride | 160/344 |
| 1,346,747 | 7/1920 | Hamilton | 160/344 |
| 1,653,586 | 12/1927 | Remhof | 160/344 |
| 2,685,337 | 8/1954 | Swafford | 160/341 |
| 3,192,995 | 7/1965 | Graber et al. | 160/345 |
| 3,383,733 | 5/1968 | Johnson . | |
| 4,308,637 | 1/1982 | Kucera . | |

*Primary Examiner*—David M. Purol

[57] ABSTRACT

A mechanism for opening and closing a shower curtain without grabbing onto the curtain material. A pull cord system is incorporated into a conventional shower curtain assembly so that the curtain can be opened or closed with minimum stress on the curtain material.

3 Claims, 1 Drawing Sheet

SHOWER CURTAIN OPERATOR

BACKGROUND AND SUMMARY OF THE INVENTION

This invention relates to a mechanism for opening and closing a shower curtain without exerting direct manual force on the curtain material.

Conventional shower curtains are often formed of flexible plastic material that is subject to tearing or breaking. The curtain is usually suspended from an overhead horizontal rod by means of a series of suspension rings spaced along the upper edge of the curtain. Each suspension ring extends over the rod and downwardly through an opening in the curtain. After a period of time the curtain is apt to tear away from one or more of the suspension rings, due to repeated manual pulling actions on the curtain material that occur when the curtain is being opened or closed.

I am proposing a mechanism that can be added to a conventional shower curtain assembly to permit the curtain to be opened and closed without direct manual grabbing of the curtain material; I believe this will tend to preserve (lengthen) the curtain life.

My opening-closing mechanism includes a flexible pull cord having horizontal cord sections running along the upper edge of the shower curtain below the curtain rod. A pulley-type guide structure is located near each end of the curtain rod for redirecting the pull cord; the cord includes vertical cord sections extending downwardly from on of the guide structures for manual actuation of the cord, i.e. movement of the horizontal cord sections to draw the curtain to the closed or open position.

The mechanism is designed to utilize most of the existing components in pre-existing shower rod assemblies, i.e. the curtain rod, the shower curtain, and the suspension rings. My mechanism is in the nature of an add-on attachment, rather than a complete shower curtain redesign. The mechanism can be used with conventional shower curtain assemblies with substantially no modification of such assemblies.

THE DRAWINGS

DESCRIPTION OF A PREFERRED EMBODIMENT OF THE INVENTION

Figure 1:
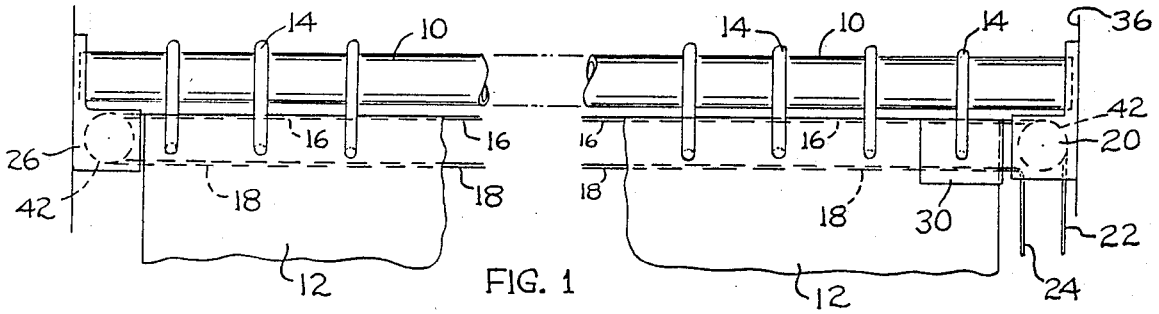
FIG. 1 is a fragmentary front elevational view of a conventional shower curtain assembly having an opening-closing mechanism of the present invention installed thereon.

Referring to FIG. 1, there is shown a shower curtain assembly that comprises a horizontal rod 10, a flexible shower curtain 12 located below rod 10, and a series of suspension rings 14 spaced along the upper edge of the curtain. Each ring 14 extends over the rod and through a transverse opening in the curtain.

My invention relates to an opening-closing mechanism for the shower curtain. As shown in FIG. 1, the mechanism includes a flexible pull cord having horizontal cord sections 16 and 18 running along the upper edge of curtain 12. At the rightmost end of the shower curtain assembly the flexible cord transitions downwardly over a guide means 20. Two vertical cord sections 22 and 24 are thus provided for manual actuation of the cord (to open or close shower curtain 12). At the leftmost end of the shower curtain assembly the flexible cord runs around a second guide means 26 so as to form the two oppositely moving cord sections 16 and 18. The two guide structures 20 and 26 will preferably be similarly constructed to reduce manufacturing costs.

Figure 4:
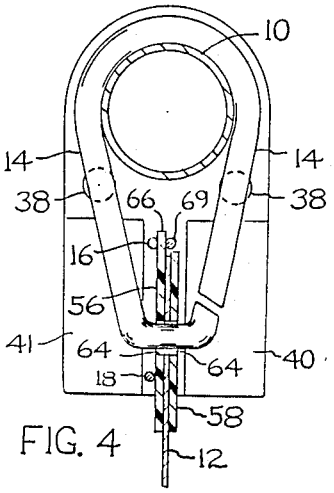
FIG. 4 is a sectional view on line 4—4 in FIG. 2.
Figure 5:
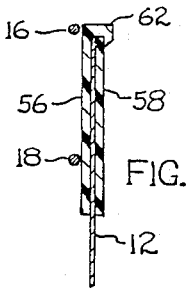
FIG. 5 is a sectional view on line 5—5 in FIG. 2.

The pull cord is attached to the upper right corner of curtain 12 by means of a plate-like attachment structure 30. The details of structure 30 are best seen in FIGS. 2, 4 and 5.

Figure 2:
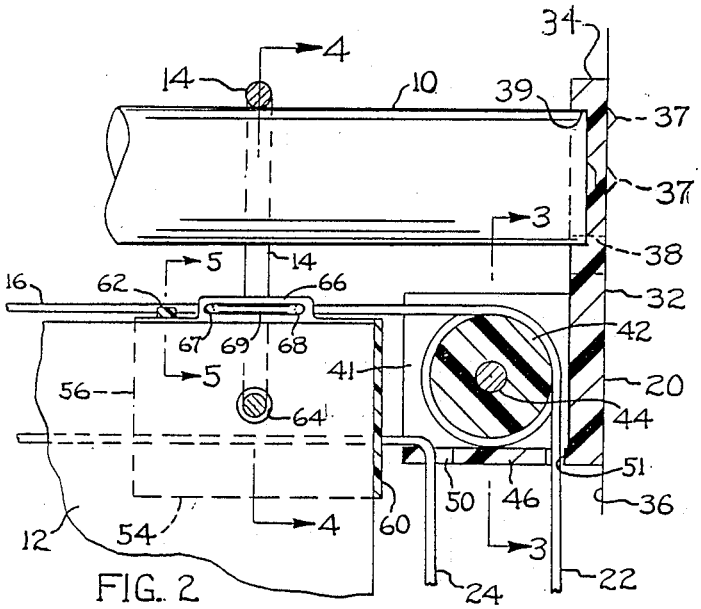
FIG. 2 is an enlarged fragmentary sectional view of a portion of the FIG. 1 assembly.
Figure 3:
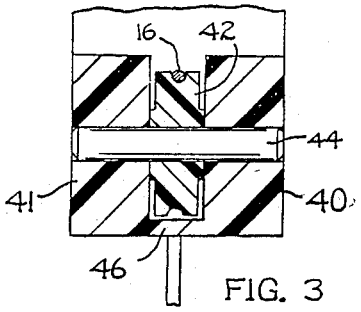
FIG. 3 is a sectional view taken on line 3—3 in FIG. 2.

Referring to FIGS. 2 and 3, guide means 20 includes a one-piece plastic bracket 32 that comprises a vertical panel 34 positionable against surface 36 of the bathroom wall. Openings 38 (FIG. 4) may be provided in panel 34 to receive mounting screws, not shown. Also, the right face of the panel may have sharp spike-like projections 37 thereon that are effective to dig into wall surface 36. An upper section of panel 34 has a circular socket 39 therein adapted to receive one end of curtain rod 10.

Two spaced-apart vertical walls 40 and 41 project right angularly from panel 32 to form a saddle mount for a horizontal axis pulley 42. A pin (or rivet) 44 extends transversely through walls 40 and 41, and a central hole in pulley 42, to thereby mount the pulley for rotation around the pin axis; the pin may have a press fit in holes drilled through walls 40 and 41.

At its lower edge plastic bracket 32 has a bridging wall 46 extending across the space between walls 40 and 41. Vertical holes 50 and 51 extend through wall 46 to freely accommodate the vertical portions of the pull cord. An edge surface of hole 50 may be curved (chamfered) as shown in FIG. 2 s that the hole edge serves to better guide the cord as it transitions between the horizontal run 18 and the vertical run 24.

The other guide structure 26 will be constructed the same as guide structure 20. Openings 50 and 51 in guide structure 26 will not be used for cord accommodation purposes. As shown in FIG. 1, the cord will extend around the guide pulley 42 to reverse direction.

Horizontal run section 18 of the cord is attached to the upper right corner of curtain 12 by means of a U-shaped plate structure 54. Structure 54 includes two flat plate sections 56 and 58 connected together by a web wall 60. A resilient hook 62 extends from plate 56 across the upper edge of plate 58, to thus hold the two plates close together against opposite surfaces of the shower curtain. The two plates have aligned circular openings 64 therethrough that are adapted to mate with an opening in the shower curtain when the plate structure is installed on the upper corner of the curtain. One of the suspension rings 14 extends through the mated openings.

Plate structure 54 includes an apertured lug (or strip) 66 projecting upwardly from plate section 56 to form an anchorage for cord section 16. Two laterally spaced circular apertures 67 and 68 are formed through lug 66. Cord section 16 runs through aperture 67 in one direction and through aperture 68 in the other direction.

Short section 69 of the cord (FIG. 2) lies against the lug surface to anchor the cord to the lug (and hence to plate structure 54).

Figure 6:
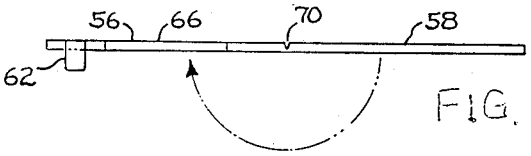
FIG. 6 is an edge view of a cord attachment plate used in the FIG. 2 mechanism. The attachment plate is shown in an unfolded state prior to usage in the FIG. 2 mechanism.
Figure 7:
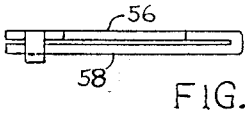
FIG. 7 is an edge view of an alternate cord attachment plate usable in practice of the invention.

Plate structure 54 may be formed as a flat member, as shown in FIG. 6; a kerf 70 may be formed in the flat member to facilitate fold-up of plate sections 56 and 58 to a usable configuration. Alternately the plate structure may be preformed into a U-configuration, as shown in FIG. 7. The plate structure is preferably a one piece plastic member.

The drawings show a pull cord system actuatable from a point at the right edge of the curtain opening; the curtain moves in a right-to-left direction to open the curtain. However, the same hardware components can be used to form a system actuatable at the left edge of the curtain opening (wherein the curtain moves in a left-to-right direction to open the curtain).

The drawing necessarily show a specific structuraled arrangement embodying the invention. However, it will be appreciated that the invention can be practiced in various different ways.

I claim:

1. In combination with a shower curtain assembly that includes a horizontal rod, a flexible shower curtain located below said rod, and a series of suspension rings extending over the rod and through openings in the curtain, to thereby suspend the curtain from the rod;

the improvement comprising means for opening and closing the curtain without manual gripment of the curtain material; said opening-closing means comprising a flexible pull cord having horizontal cord sections running along the upper edge of the flexible curtain, means at each end of the horizontal rod for guiding and redirecting the pull cord, and means for attaching said cord to an upper corner of the curtain;

each said guiding-redirecting means comprising a bracket structure adapted to seat against a bathroom wall surface between said surface and the associated end of the shower curtain rod, and a horizontal axis pulley rotatably mounted on each said bracket structure directly below the curtain rod;

said cord-curtain attaching means comprising a U-shaped plate structure formed entirely of plastic; said U-shaped plate structure comprising two spaced parallel vertical plates having upper edges thereof elevated slightly above the upper edge of the shower curtain, and a resilient integral hook extending from one plate across the upper edge of the other plate to maintain the two plates clamped against opposite faces of the curtain; said cord-curtain attaching means further including a horizontally elongated apertured lug projecting upwardly from the U-shaped plate structure, said lug having two cord-receiver apertures extending therethrough to attach the plate structure to the cord; said cord-receiver apertures being horizontally spaced along the upper edge of the curtain so that the attached cord section maintains a horizontal orientation along the curtain upper edge.

2. The improvement of claim 1, wherein said vertical plates have two aligned openings therethrough adapted to mate with an opening in the curtain, whereby the associated suspension ring extends through the aligned openings when the plate structure is installed on the curtain.

3. In combination with shower curtain assembly that includes a horizontal rod, a single flexible shower curtain located below said rod, and a series of suspension rings extending over the rod and through openings in the curtain, to thereby suspend the curtain from the rod;

the improvement comprising means for opening and closing the curtain without manual gripment of the curtain material; said opening-closing means comprising a flexible pull cord having horizontal cord sections running along the upper edge of the flexible curtain, means at each end of the horizontal rod for guiding and redirecting the pull cord, and means for attaching said cord to an upper corner of the curtain;

said cord-curtain attaching means comprising a U-shaped plate structure having facial clamping engagement on opposite faces of the curtain;

each side guiding-redirecting means comprising a bracket structure adapted to seat against a bathroom wall surface between said surface and the associated end of the shower curtain rod, and a single horizontal axis pulley rotatably mounted on each said bracket structure directly below the curtain rod;

each bracket structure being a one piece plastic member having the same structural configuration; each bracket structure comprising a vertical plate (34) having an upper section and a lower section, a socket (39) in said upper section adapted to receive an end of the shower curtain rod, two spaced-apart vertical walls (40 and 41) projecting right angularly from the panel lower section to form a saddle mount for the associated pulley, and a bridging wall (46) extending between said spaced-apart vertical walls at the lower edge of the bracket structure; said bridging wall having a cord guide hole (50) extending therethrough; said guide hole having a curved upper edge surface adapted to slidably engage the pull cord as the cord transitions between a horizontal run direction and a vertical run direction; each said bridging wall being an integral part of the associated bracket structure.

* * * * *